US006716008B1

(12) United States Patent
Kachele

(10) Patent No.: US 6,716,008 B1
(45) Date of Patent: Apr. 6, 2004

(54) ECCENTRIC SCREW PUMP WITH EXPANDED TEMPERATURE RANGE

(75) Inventor: Bruno Kachele, Weilheim (DE)

(73) Assignee: Wilhelm Kachele GmbH Elastomertechnik, Weilheim (DE)

( * ) Notice: Subject to any disclaimer, the term of this patent is extended or adjusted under 35 U.S.C. 154(b) by 0 days.

(21) Appl. No.: 10/267,617

(22) Filed: Oct. 9, 2002

(30) Foreign Application Priority Data

Sep. 27, 2002 (DE) ..... 102 45 497

(51) Int. Cl.[7] ..... F01C 1/107
(52) U.S. Cl. ..... 418/48; 418/153
(58) Field of Search ..... 418/48, 153, 178

(56) References Cited

U.S. PATENT DOCUMENTS

| | | | | | |
|---|---|---|---|---|---|
| 3,499,389 A | * | 3/1970 | Seeberger et al. | ..... | 418/48 |
| 4,104,009 A | * | 8/1978 | Chanton | ..... | 418/48 |
| 4,773,834 A | * | 9/1988 | Saruwatari | ..... | 418/48 |

FOREIGN PATENT DOCUMENTS

| | | | | | |
|---|---|---|---|---|---|
| DE | 1553149 | * | 10/1970 | ..... | 418/48 |
| DE | 2017620 | * | 11/1971 | ..... | 418/48 |
| DE | 2259125 | * | 6/1974 | ..... | 418/48 |
| RU | 1671974 | * | 8/1991 | ..... | 418/48 |

* cited by examiner

*Primary Examiner*—John J. Vrablik
(74) *Attorney, Agent, or Firm*—Leydig Voit & Mayer, Ltd.

(57) ABSTRACT

An eccentric screw pump or motor which includes; stators (3) having an elastic flexible coatings (32) which forms a helical bore with teeth (37) and tooth gaps (38) and a rotor (4) disposed for rolling movement in the bore and being formed with teeth (35) and tooth gaps (36) which are engageable with the stator bore. To enhance performance over a wider range of operating temperatures, the bore defined by the elastic flexible coating is formed with a plurality of waves (4) and grooves (39) which, like the teeth (37) and tooth gaps (38) of the bore are helical, but which have dimensions in both the circumferential and radial directions that are smaller than the dimensions of the teeth (37) and tooth gaps (38) of the bore.

32 Claims, 9 Drawing Sheets

ECCENTRIC SCREW PUMP WITH EXPANDED TEMPERATURE RANGE

FIELD OF THE INENTION

The present invention relates to eccentric screw pumps and motors, and more particularly, to pumps and motors which have a screw-type motor eccentrically disposed within a stator for relative rotational movement.

BACKGROUND OF THE INVENTION

Eccentric screw pumps or motors consist of a stator with a helical bore or passage within which a helical rotor rotates. The number of threads of the helical rotor is one less than the number of threads in the bore of the stator. During the rotation of the rotor, the rotor rolls with a positive fit in the threading of the bore. In relation to gears, there is a spiral-toothed pinion, which rolls in a spiral-toothed spur wheel, wherein the number of teeth of the pinion and spur wheel differ by one. During the rotation of the rotor, its longitudinal axis ideally moves on a circular path with the diameter of the circular path corresponding to twice the eccentricity ratio to the stator.

Because both the outer surface of the rotor and the bore in the stator are helical with the same turning direction, approximately banana-shaped hollow spaces or chambers are generated along the rotor. These spaces or chambers advance from one end of the stator in the direction towards the other end during the rotation of the rotor. Each of these banana-shaped chambers is isolated and sealed from the other chambers, which enclose other regions of the stator with other regions of the rotor.

To guarantee a good seal between the individual chambers, the stator has an elastomer coating. The inner wall of the stator, for example, may consist of an elastomer material which is pressed onto the rotor in the region of contact points with the rotor. The resulting relative motion between the stator and the rotor is not a pure rolling motion. Due to the seal between the stator and the rotor, a sliding motion occurs over wide stretches.

If an eccentric screw pump is charged with a compressed medium, it also can be used as an eccentric screw motor. This principle can be applied to underground boring motors (i.e. mud motors). Because eccentric pump motors consist of very few components, they are very narrow in diameter but nevertheless can generate great torque.

The medium that is pumped or used for the drive can contain particles without risking damage to the pump or motor, which is another advantage of eccentric screw pumps and eccentric screw motors. Eccentric screw pumps are used, for example, to convey mortar. Thus, it can be used with a material that contains a high percentage of solid particles.

The operating temperature of an eccentric screw pump or an eccentric screw motor is a function of the flow rate, the ambient temperature, the specific heat of the flowing medium, and the friction between the stator and the rotor. The friction generates heat, which is carried off by the medium. An eccentric screw pump reaches operating temperatures up to 300° C. depending on the ambient temperature and its operating efficiency. Therefore, it must handle a temperature jump of up to about 280° C. when started from room temperature under normal conditions.

The elastomer coating used in screw pumps and motors commonly consists of a synthetic elastomer or a compound of such material with natural rubber. Both materials exhibit a strong temperature profile, i.e., the coefficient of expansion is relatively high. Thus, the thin width in the stator changes considerably as a function of temperature. At low temperatures, the rotor turns easily in the stator, while at high temperatures, the material of the inner coating can expand to the extent that the rotor is practically stopped. Then, if the rotor is turned externally with the aid of a drive, the teeth tear away the elastomer coating in the bore. The friction losses, which occur within the eccentric screw pump or the eccentric screw motor, also are strongly dependent on temperature and on the medium.

For geometries used until now, the bore of the stator has had a relatively smooth, wave-shaped profile. This wave-shaped profile can be calculated by a person skilled in the art by means of known geometric relationships. In the broadest sense, the teeth have the shape of cycloid teeth, wherein the teeth and the teeth gaps are rounded.

Why the stator may be stopped in the rotor as mentioned above, can be understood when considering a disk-shaped section of the eccentric screw pump, assuming there are five bores in the stator and four teeth on the rotor. In one position, one tooth of the rotor descends into a tooth gap of the bore, while the opposite tooth of the rotor slides over the opposite tooth gap of the bore during the rolling motion. The more the elastomer coating expands inwardly in the radial direction due to temperature expansion, the smaller the distance between the tooth crown and the base of the opposite tooth gap, which correspondingly increases the stopping force of the rotor.

The operating temperature range of known eccentric screw pumps and eccentric screw motors also cannot be increased since the inner dimensions of the elastomer coating are designed according to the high operating temperature. In the cold state, the rotor would no longer be sufficiently sealed relative to the inner wall of the bore since the elastomer coating shrinks too much as a fumction of temperature.

Eccentric screw pumps also are used for the purpose of conveying pure water. Here, water is a relatively good lubricant for the rubber-metal material mating pair. However, due to the frictional movement between rotor and stator inner wall, the water film is stripped, which leads to dry contact between the coating and the rotor over a relatively broad strip, which produces increased squeaking noises.

OBJECTS AND SUMMARY OF THE INVENTION

It is an object of the present invention to provide an improved eccentric screw pump or motor which is functional over a broader temperature range.

Another object is to provide an eccentric screw pump or motor as characterized above which incurs less internal friction at a given temperature than prior art designs.

A further object is to provide an eccentric screw pump or motor which is operable for use with pure water with lesser tendency to generate noise.

For displacement-type machines according to the invention, the concept behind the profile of the inner bore of the stator of the inventive machine first will be described in relation to eccentric screw pumps or motors according to the state of the art. In groove profiles resulting from the concept of the invention, there are flat grooves, which transition with rounded side surfaces into the other profile. In this case, the profile of the inner bore is similar to waves set one next to another, which are separated from each other by the grooves. Such grooves can be placed in the crown surfaces of the teeth or in the thread valleys of the inner bore of the stator or both in the crown surfaces of the teeth and also in the teeth gaps. As a result of these grooves, the lengths over which the rotor contacts the coating in a frictionally engaged way, as viewed in the circumferential direction, are significantly reduced for the same sealing effect. Simultaneously, the contact force can be decreased.

As soon as a rotor tooth bridges a groove, two seal edges are produced which seal the tooth. Each of these seals can be pressed with considerably less force without resulting in breaks in the seal. In addition, the material of the coating can be concentrated in the region of the groove for passage of the tooth of the rotor from the raised region, which achieves greater flexibility.

Even if the width of the inner bore becomes smaller due to thermal expansion of the elastomer material, tolerable contact forces are still produced. The reduction of contact force, as well as the reduction of the thin width, is realized from the ability to displace the material as described above into the region of a groove. Thus, the material is in a better position to expand. In addition to the grooves, there also can be waves on both sides of each groove, which are raised relative to the smooth profile. The configuration of the stator according to the invention is advantageous for eccentric screw arrangements that work both as pumps and as motors.

The jacket that surrounds the elastomer coating can border either a cylindrical inner space or a helical inner space. In the case of the helical inner space, the thickness of the elastomer coating is approximately the same at all points, while for the cylindrical inner space, the thickness in the region of the teeth of the bore is significantly thicker and thus more flexible. There can be additional waves or grooves not only in the crowns of the teeth or in the teeth gaps but also in the sides that connect the crown of the teeth to the teeth gaps.

The dimensions of the waves or grooves, seen in the circumferential direction, can be greater at the crowns of the teeth than in the teeth gaps. Especially favorable relationships are produced if the waves in the teeth are symmetrical to a crown line, which follows the contours of the teeth and which exhibits the smallest radial distance from the bore axis. Thus, directly on the crown line there is no wave. The same structure also can be used in the teeth gaps.

An especially favorable arrangement relative to the tooth gap is produced if there is a wave directly in the valley line, which exhibits the greatest radial distance from the axis of the bore. In this way, the tooth gap in which the tooth of the rotor cuts most strongly can provide an especially soft support. At least for a few waves or grooves, the cross-sectional profile through the waves is essentially symmetrical as seen in the circumferential direction of the bore.

According to the purpose of the application, the pitch of the waves or grooves can equal the pitch of the stator or the pitch of the rotor, or alternativcly, the pitch can assume an intermediate value. In that regard, differing pitches have special advantages if water is to be pumped or used as the drive medium. The grooves can produce equal lubricant chambers from which water can be discharged for lubrication.

Other objects and advantages of the invention will become apparent upon reading the following detailed description and upon reference to the drawings, in which:

Figure 1:
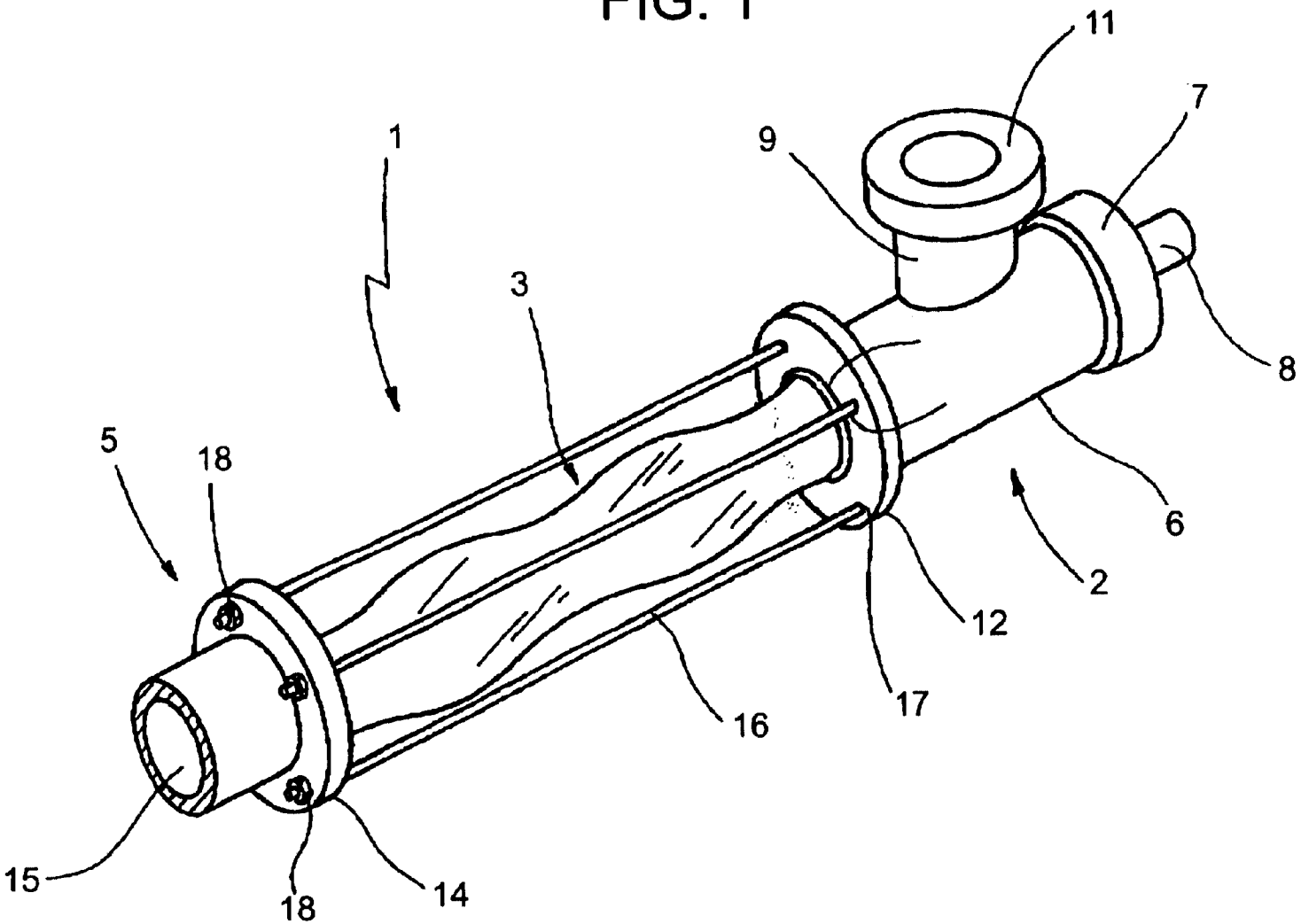
FIG. 1 is a perspective of an illustrative eccentric screw pump in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring now more particularly to FIG. 1 of the drawings, there is shown an illustrative eccentric screw pump, as an example of a displacement-type machine in accordance with the invention. It will be understood that alternatively the machine can take the form of an eccentric screw motor, such as used in oil bores and the like. For purposes herein, the description of the illustrative embodiment is intended to encompass displacement-type machines which are in the form of either an eccentric screw pump or motor.

Figure 2:
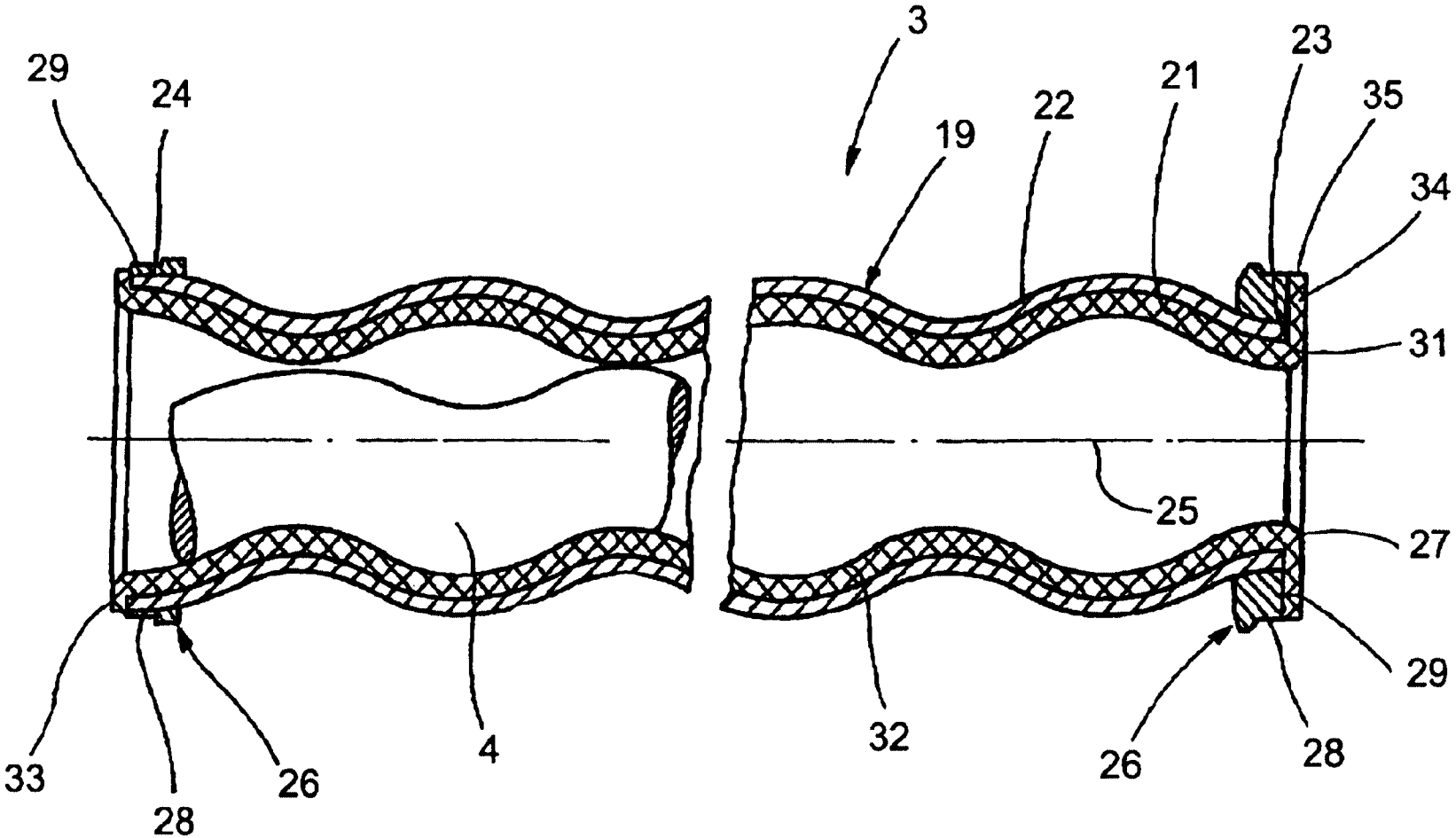
FIG. 2 is a longitudinal section of the stator of the illustrated screw pump, including a depiction of a portion of the rotor.

The illustrated eccentric screw pump 1 includes a pump head 2, a stator 3 within which a rotor 4 is rotatable, as depicted in FIG. 2, and a connecting head 5 at an end of the stator opposite the pump head 2. The pump head 2 has an essentially cylindrical housing 6, which has a cover plate 7 on one outer end, through which a drive shaft 8 extends from the outside in a sealed manner. A connecting socket 9 which has at a fastening flange 11 opens in the radial direction in the housing 6. In the interior of the housing 6, as is typical for eccentric screw pumps, there is a coupling piece between the drive shaft 8 and rotor 4 so that when the drive shaft is driven by an appropriate drive motor (not shown) the parts rotate together. The outer end of the housing 6 opposite the cover plate 7 is provided with a spring flange 12, the diameter of which is greater than the diameter of the essentially cylindrical housing 6. The spring flange 12 has a stepped bore 13, which is aligned with the inner space of the housing 6. The stepped bore 13 defines an appropriate contact shoulder against which one end of the stator 3 presses in a sealed manner.

The connection head 5 has a spring flange 14 which is connected to the spring flange 12. The spring flange 12 also has a stepped bore in which the other end of the stator 3 is inserted. A pipe line 15 leading away from the spring flange 14 is aligned with the stepped bore therein.

Between the two spring flanges 12, 14, the stator 3 is tightly tensioned in a sealed manner with the aid of four tension rods 16. For holding the four tension rods 16, the two spring flanges 12, 14 are each provided with four bores 17 that are aligned with each other and lie on a pitch circle that is greater than the outer diameter of the housing 6 or the tube 15. The rod-shaped tension rods 16 are extended through the bores 17. On the outer opposite sides of the spring flanges 12, 14, nuts 18 are screwed on the tension rods 16 such that the two spring flanges 12, 14 are pulled tightly to each other.

In the case of mud motors, it will be understood that threaded connectors are used instead of spring flanges.

As FIG. 2 illustrates, the stator 3 includes a tube-shaped jacket 19 having a constant wall thickness surrounding an inner space 20. The jacket 19 may be made of plastic, steel, steel alloy, light metal, or a light-metal alloy. It is shaped so that an inner wall 21 forms the shape of a multi-bore screw. Its outer side 22 has a correspondingly similar shape with a diameter that is greater, corresponding to the wall thickness of the jacket 19, than the diameter of the inner space 20 of the jacket 19. The jacket 19 has outer ends with end surfaces 23, 24 which are perpendicular relative to its longitudinal axis 25, which corresponds to the longitudinal axis of the inner space 20.

In the simplest case, the inner space 20 has the form of a two-bore screw. Thus, the cross section of the outer surface 22, as seen perpendicular to the longitudinal axis 25, has the shape of an oval, similar to a racetrack. To adapt this oval geometry to the stepped bore 13, a sealing or reducing ring 26 is provided at each outer end of the jacket 19. Alternatively, the ends can be formed as cylindrical tubes. The sealing ring 26 has a through-hole 27 that corresponds to the profile of the outer surface 22 over the length of the sealing ring 26. In other words, the sealing ring 26 acts, in the broadest sense, as a nut that is screwed on the threading defined by the jacket 19. The length of the threading corresponds to the thickness of the sealing ring 26.

The sealing ring 26 in this case has an outer cylindrical surface 28, which transitions in the axial direction into a flat surface 29 that projects away from the jacket 19.

On the inner side 21, the jacket 19 is provided with a continuous coating 32 over its entire length. The coating 32 may be an elastic, flexible, preferably elastomer material, e.g., natural rubber or synthetic material, and has approximately the same wall thickness at every point.

Figure 3:
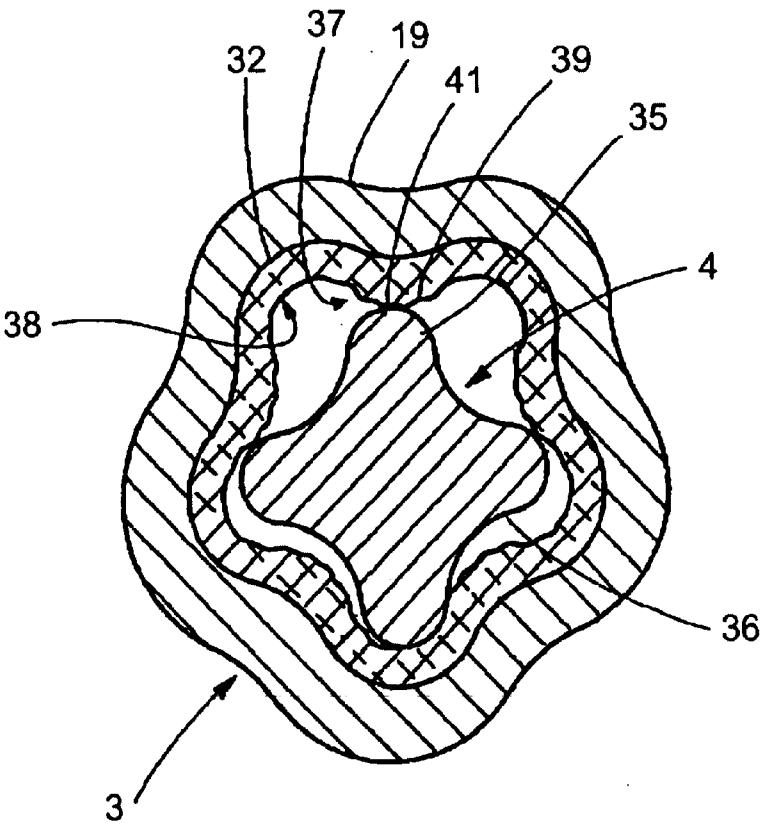
FIG. 3 is an enlarged transverse section, i.e. perpendicular to the longitudinal axis, of the rotor and stator of the illustrated eccentric screw pump.

FIG. 3 shows a cross section through the stator 3 containing the rotor 4, wherein the stator has five inner bores and the rotor has four threads. Such arrangement is similar to a four-toothed pinion that rolls in a five-toothed spur wheel. The spur wheel and pinion in such case are spiral-toothed and engage each other correspondingly over the entire length. Accordingly, the regions extending outwardly of the rotor 4 are designated in the following as teeth 35 and the intermediate regions are designated as tooth gaps 36. The cross-sectional profile is similar to a rounded cycloidal profile. Likewise, the regions of the stator 3 projecting inward also are designated as teeth 37 and the gaps between are designated as tooth gaps 38.

The manner and method in which an eccentric screw pump or an eccentric screw motor operates is well known in the art and need not be described herein at length. It suffices to state that the stator 3 generates several pump chambers separated in the circumferential and longitudinal directions during rotation of the rotor 4, wherein these chambers are approximately banana-shaped and move, in the case of a pump, in the direction towards the end with the higher pressure, and in the case of a motor, to the end with the lower pressure.

Although the metal parts of the eccentric screw pump 1 exhibit only a comparatively low thermal expansion, the wall thickness of the elastomer coating 32 changes considerably with temperature. Accordingly, the thin width of the space bounded by the elastomer coating 32 decreases with an increase in temperature. The distance between a tooth 37 and an opposite tooth gap 38 decreases so that the stress with which the elastomer coating contacts the teeth 35 of the rotor 4 rises. As temperature increases, the change in the narrow width can be so large that during operation the tooth 35 of the rotor 4 can damage the contacted tooth 37 of the elastomer coating 32 at the crown.

Figure 4:
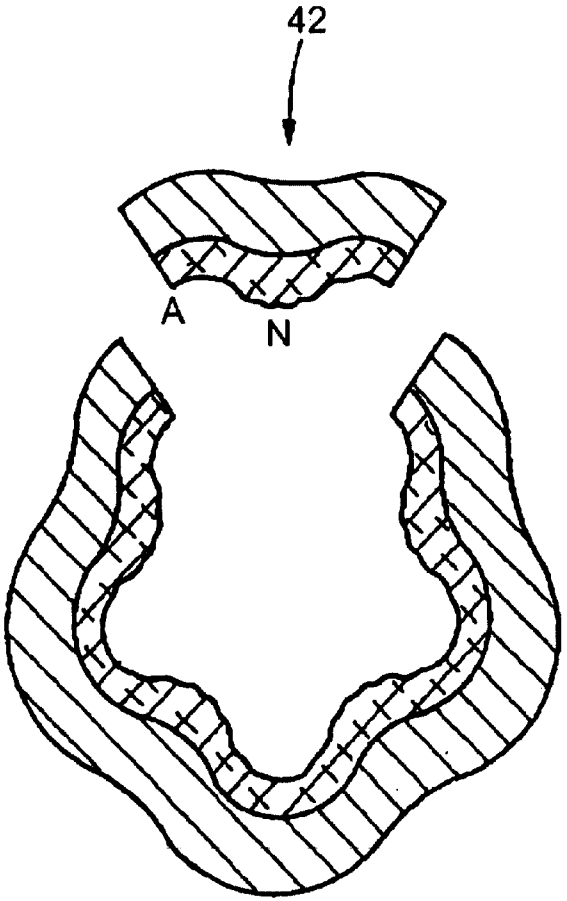
FIG. 4 is a transverse section of the stator shown in FIG. 3, with a portion broken away for purposes of illustration.
Figure 5:
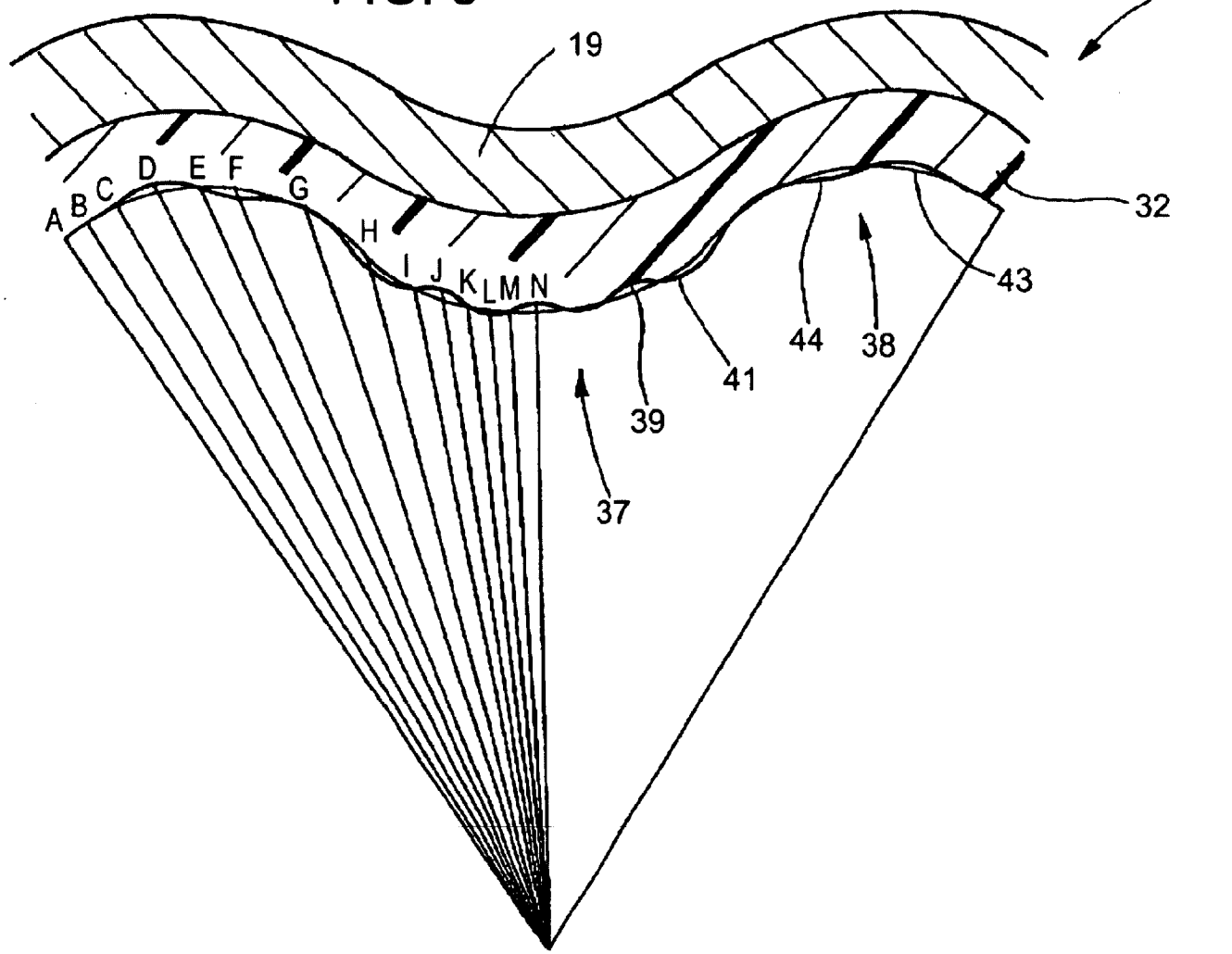
FIG. 5 is an enlarged fragmentary section of the detached stator portion of the stator shown in FIG. 4.
Figure 6:
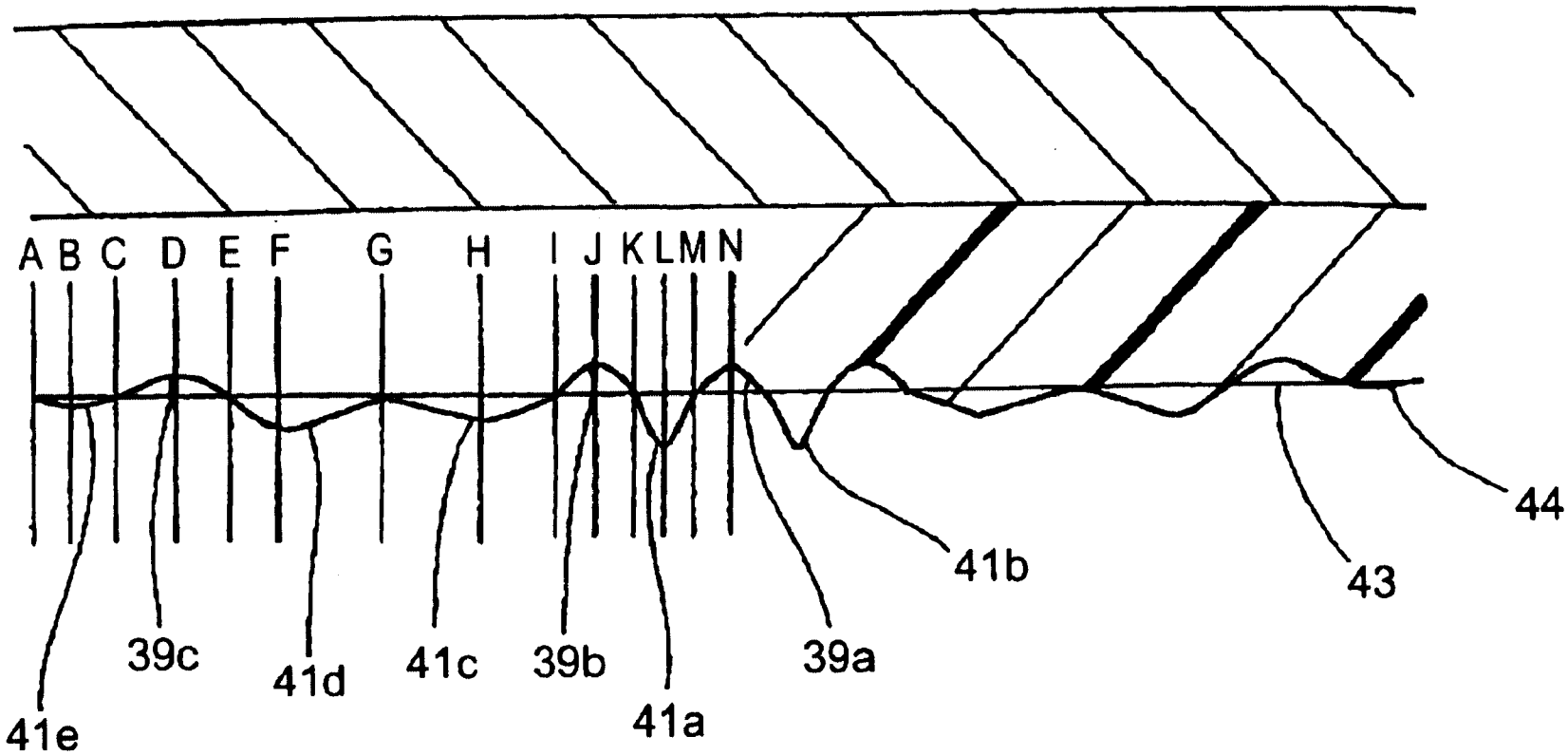
FIG. 6 is an enlarged view of the detached stator section shown in FIG. 5 with the waves and grooves thereof shown in a flat profile.

In accordance with the invention, to counteract the foregoing problem each tooth 37 is provided with grooves 39 and/or waves 41. For better illustration of the shape of the grooves 39 and the waves 41, a section 42 from the stator 3 is shown removed in FIG. 4. The section 42 furthermore is illustrated in an enlarged fashion in FIG. 5. Here, the waves 41 and the intermediate grooves 39 can be seen easily. To make the profile of the grooves 39 and the waves 41 even more visible, the section 42 is illustrated in stretched out fashion in FIG. 6, i.e., with the waviness that the profile of the teeth 37 and the tooth gaps 38 eliminated, and the ideal profile line 43, which defines the teeth 37 and the intermediate tooth gaps 38, shown as a straight line. Moreover, for better orientation in the figures, each point that has the largest radial distance from the axis 25 in the tooth gap 38 is designated by A, and the crown line of the tooth 37 is designated by N. The points between, B to M, coincide with crowns of waves, crown lines of grooves or intersection points, at which the actual contour lines intersect the smoothened contour corresponding to the straight line 43.

In the illustrated design, in the crown of a tooth 37, i.e., at N, there is a groove 39*a*, whose deepest point coincides with the imaginary crown of the tooth 37. Rising on both sides of the groove 39*a* are waves 41*a* and 41*b*. These waves rise over the profile line 43, i.e., they project more greatly into the inner space than that corresponding to the ideal contour line 44. Next to the wave 41*a* there is, in turn, a groove 39*b*, at which the actual contour line 43 recedes relative to the contour line 44 in the radial direction. The groove 39*b* ends at the point I. Here, the actual contour line 44 intersects the smoothened line 43 to form the wave 41*c*in connection.

The wave 41*c*ends at the point G on the smoothened contour line 43. In connection to this, there results a wave 41*d* that transitions at E into a groove 39*c*. The groove 39*c* is, in turn, deeper than the contour line 43. At the deepest point of the tooth gap 38 at A, the actual contour line 44 intersects the smoothened contour line 43, wherein a small wave 41*e* still rises between this point and the groove 39*c*.

The foregoing form of grooves and waves 39, 41 repeats periodically, wherein the axes of symmetry are the crown lines of the teeth or the crown lines of the tooth gaps 37, 38. As can be seen, there are grooves 39 and waves 41 not only in the crown surfaces of the teeth 37 or in the deepest regions of the tooth gaps 38, but also in the side surfaces that connect the crown surfaces to the valleys of the tooth gaps 38.

As can be seen in the figures, the "wavelength," which is set by the grooves 39 and the waves 41 is significantly smaller than the "fundamental wave" formed by the teeth 37 and the tooth gaps 38. It is equal to approximately ⅛ the fundamental wave, i.e., between two tooth gaps 38 there are at least 8 indentations and/or bulges.

In contrast, the height, i.e., the amplitude, measured between the deepest point between two waves or a groove and the highest point of an adjacent wave, is equal to only a fraction of the wall thickness of the elastomer coating 32 at the relevant point. The amplitude is in the range between 0.1 mm and 5 mm, preferably between 0.1 mm and 2mm, and most preferably between 0.2 mm and 0.8 mm, or twice that amount. In percentages, the thickness of the elastomer coating 32 is between 1% and 50%, preferably between 1.5% and 30%, and most preferably between 2% and 20%.

Figure 7:
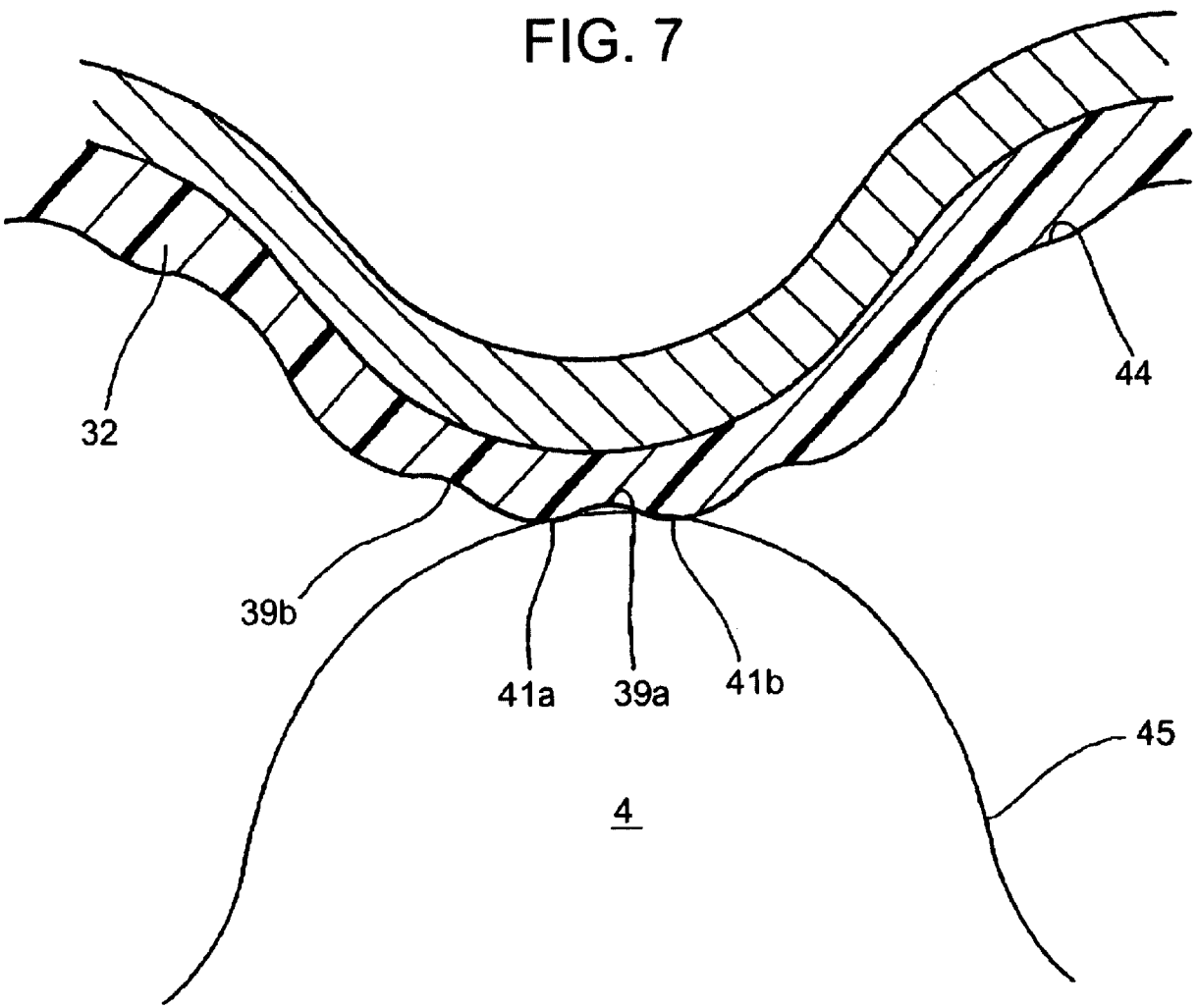
FIGS. 7–9 are fragmentary sections depicting different engagement relations between the rotor and stator in the region of the tooth crest of the rotor and in tooth gaps.
Figure 8:
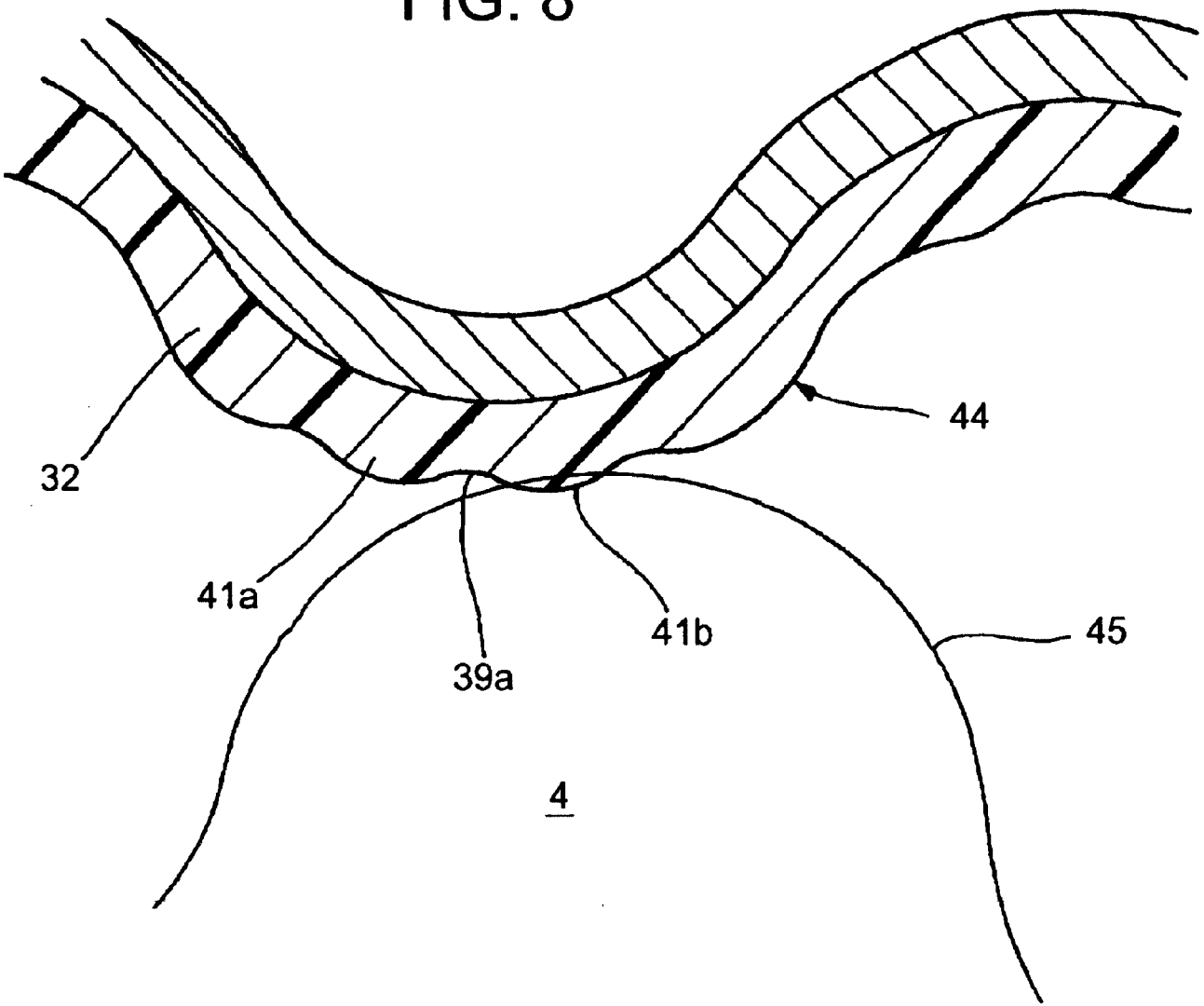
Figure 9:
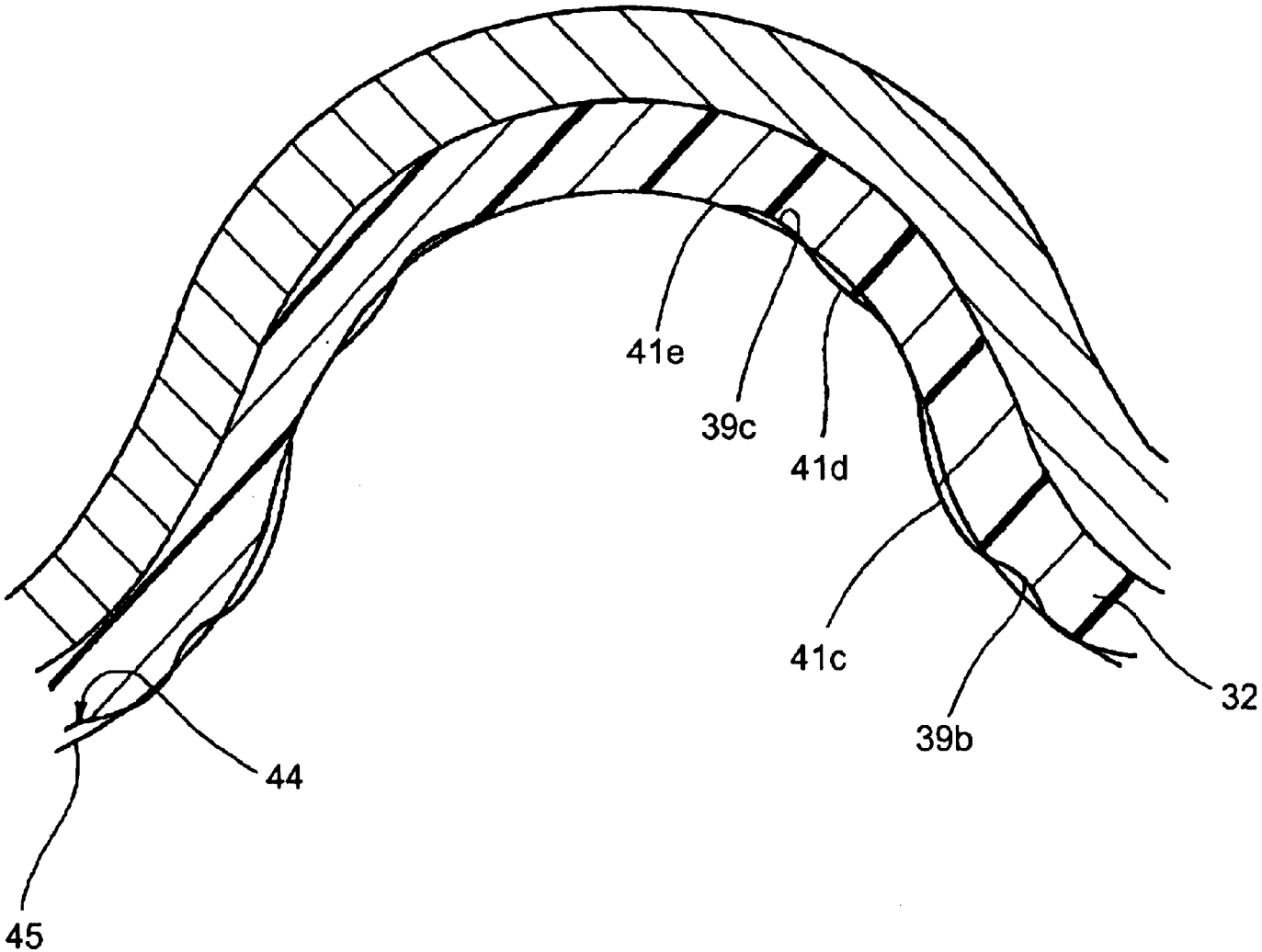

In FIGS. 7–9, several phases of the interaction between the rotor 4 and the inner wall of the elastomer coating 32 are shown. In these illustrations, a line 45 represents the outer contour of the rotor 4. For more visibility of the engagement between the rotor 4 and the elastomer coating 32, the contact points with the rotor 4 are shown undeformed. Correspondingly, the contour line 45 intersects the contour line 44. Obviously, during the actual operation, the contour line 44 deforms at the contact point with the rotor 4 such that it follows the contour line 45 at a slight distance.

FIG. 7 depicts the crown of the tooth 35 directly opposite the crown of a tooth 37. As a consequence at this point, the contour line 44 intersects the two waves 41*a* and 41*b*, while it does not reach the base of the groove 39*a*. Here, space is created if during the actual operation the tooth 35 pushes before it a wave made of elastomer material. This material can be displaced temporarily in the groove 39*a*. Hence, the retention of the sealing effect, which is achieved at this position by two waves, namely the two waves 41*a* and 41*b*, generated by a smaller contact force.

The contact force is approximately proportional to the degree of overlap of the two contour lines 44 and 45, i.e., the more the contour line 44 moves into the region bounded by the contour line 45, the more the elastomer coating 32 must be deformed at the relevant point if the tooth 35 is to pass. In the extreme position, as represented in FIG. 7, only a very small deformation is required. Simultaneously, a good sealing effect is achieved since there are two contact points for sealing between adjacent chambers so that at each wave there is only one-half of the pressure difference.

It also can be seen from FIG. 7 that the thermal expansion of the elastomer coating 32 does not have as much effect on the stress force in comparison with a situation in which there is no groove 39*a*, but instead, conventional smoothened contour profile corresponding to the contour line 43. Due to the groove 39*a* the thickness of the elastomer coating 32 can grow and then the space is opened, such that the front bow wave before the tooth 35 can move into the groove, without damaging the elastomer coating 32 at this point.

FIG. 8 shows a situation in which the thickness of the tooth 35 has increased and is in a position in which there is maximum overlap between the contour line 44 of the tooth 35 and the contour line 43 of the undeformed elastomer coating 32. From this figure, it can be seen how space is now formed next to the wave 41*b*, the groove which is present there and which corresponds to groove 39*b* from FIG. 6, such that the bow wave made of elastomer material generated during operation can be moved and push the tooth 35 before itself. Simultaneously, it can be seen why the stronger overlap sets a larger contact force so that sealiang can be achieved with only one wave in this state.

Although high stress is produced in the phase according to FIG. 8, friction is reduced by the same amount. For elastomer material, the coefficient of sliding friction is surface dependent. Here, the friction behavior is different for the elastomer-metal pair than the friction behavior for the metal-on-metal material pair. The arrangement thus exhibits low friction in the phase according to FIG. 7 and also in the phase according to FIG. 8, in comparison with an arrangement according to the state of the art in which the inner contour of the elastomer coating 32 would not correspond to the contour line 43 but instead to the contour line 43 from FIGS. 5 and 6. The extent of contact is shorter in the circumferential direction.

Finally, FIG. 9 shows the situation in which a tooth 35 penetrates to a maximum into a tooth gap 38 of the stator 3. The overlap between the crown of the contour line 44 and the valley of the tooth gap 38 is extremely small, i.e., it produces there only a small stress force. The waves 41*d* and 41*c* also generate only small forces.

Due to the contour of the bore in the stator according to the invention, as seen in the circumferential direction, it is possible to enlarge the operating temperature range of the eccentric screw pump or the eccentric screw motor. This means that a sufficient seal also is created in the cold state, While in the upper tempelature range, excessive stress forces arc not produced.

The profile according to the invention of the bore in the stator 3 also enables the axis of the rotor to stay better on the eccentricity circle during rolling movement of the rotor 4, which ideally describes the axis of the rolling motion. Each interruption of the path curve leads to increased loads and increases the drive power because the chamber volume must be changed.

Figure 10:
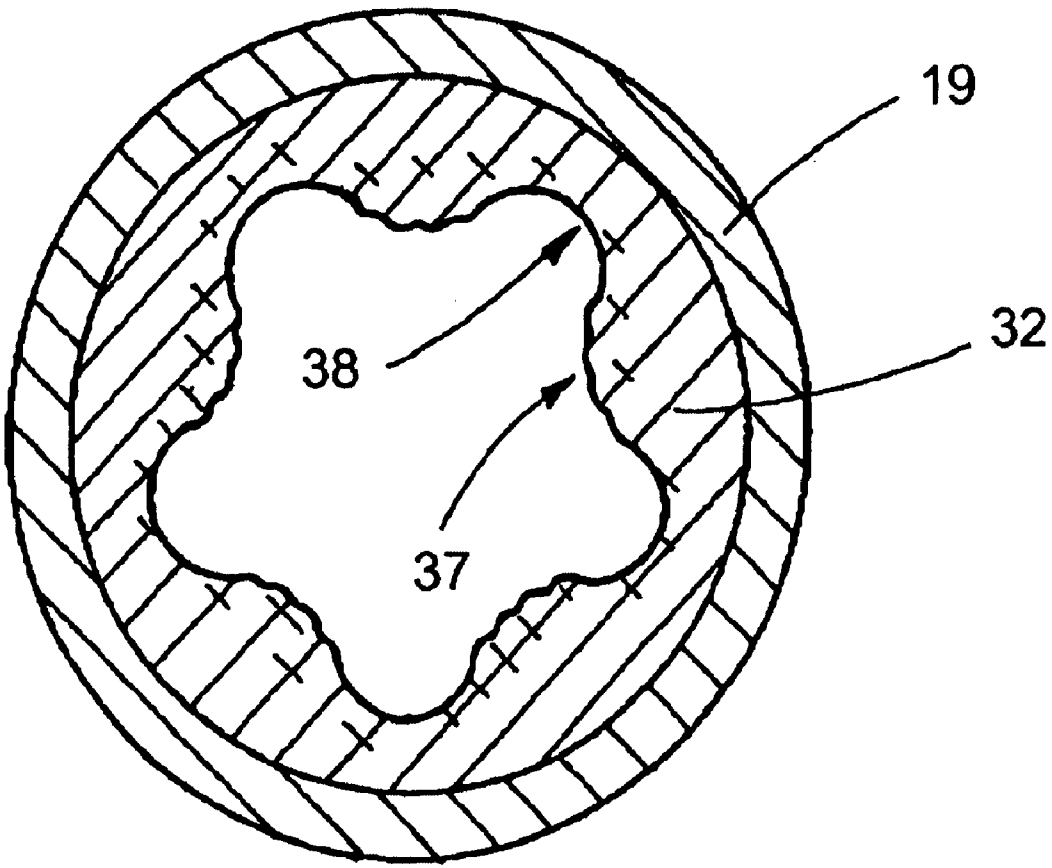
FIG. 10 is a transverse section of an alternative embodiment of stator having a cylindrical outerjacket.

The contour according to the invention can be used not only for arrangements for which the elastomer coating 32 exhibits approximately the same wall thickness at every point of the circumference, but also for arrangements such as shown in FIG. 10. Here, the jacket 19 has the form of a cylindrical tube with a cylindrical inner space. The outer contour of the elastomer coating 32 is correspondingly cylindrical. Thus, in the region of a tooth, the wall thickness is significantly greater than in the region of a tooth gap 38.

Although in the region of the teeth 37 there is better flexibility due to the greater wall thickness, the contour according to the invention, which consists of waves and grooves, again is advantageous. For a temperature increase, the wall thickness in the region of the tooth becomes greater in terms of size than the wall thickness in the region of a tooth gap. As a consequence of the greater flexibility on the tooth crown, with the use of the wave and groove structure, the displacement effect arising by reason of the change in tooth thickness is reduced. The path disruption, which adversely affects the axis of the rotor 4 during rolling motion, remains smaller.

Although the invention is described above with express reference to an eccentric screw pump, it is understood that the invention also is applicable to an eccentric screw motor in the same way and with the same advantages. Indeed, eccentric screw pumps and eccentric screw motors are different, in the end, only in the flow direction of the medium and, if necessary, in the slope of the threads that define the teeth. In fact, there also are cases in which the pitch used in pumps is equal to the pitch used in motors. There is no difference in principle in the mechanics.

From the foregoing, it can be seen that for an eccentric screw pump or an eccentric screw motor, the teeth project inwardly in the stator and intermediate tooth gaps are provided with an additional groove and wave structure. The friction between the stator and the rotor is reduced because the contact force can be reduced, while retaining the same sealing effect, or for increased contact force, the contact surface is reduced.

What is claimed is:

1. A displacement machine in the form of an eccentric screw pump or motor (1) comprising a stator 3 having a tube-shaped jacket (22), said jacket (22) having a connector (26) at one end for enabling connection of the jacket (22) to another part (2, 5), said jacket having an elastic, flexible coating (32) on an inner side thereof which forms a helical bore over a region of its length, said helical bore forming an inner wall which has a cross sectional profile transverse to a longitudinal axis of the tube shaped jacket (22) defined by an edge (44) having a wave-shaped profile such that the bore defines helical teeth (37) which are separated from each other by tooth gaps (38), said inner wall cross sectional profile of said bore being formed with a plurality of additional waves, (41) each of which extends helically in a longitudinal direction and whose dimensions in both the circumferential and radial directions are smaller than the dimensions of said teeth (37) of said bore, each tooth defined by said wave-shaped profile being formed with at least one of said additional waves (41), a rotor (4) disposed within said bore for relative rolling movement, and said rotor (4) being in the form of a spiral-toothed pinion with one or more teeth (35) and tooth gaps (36) which are disposed within the bore defined by said coating (32) such that said rotor can roll in the bore with the teeth (35) of the rotor engaging the tooth gaps (38) of the coating (32).

2. The displacement machine of claim 1 in which the number of teeth (35) of the rotor (4) is less by at least one than the number of teeth (37) of the bore in the coating (32).

3. The displacement machine of claim 1 in which said stator (3) has at least two teeth.

4. The displacement machine of claim 1 in which said jacket (22) has a cylindrical inner surface (21), and said elastic, flexible coating (32) has in the region of the tooth gaps (38) a significantly smaller radial thickness than in the region of the teeth (37).

5. The displacement machine of claim 1 in which said elastic, flexible coating (32) has a substantially uniform radial thickness.

6. The displacement machine of claim 1 in which the jacket (22) has a helical inner surface (21), and said elastic, flexible coating (32) in the region of the tooth gaps is approximately equal to the thickness of the elastic, flexible material (32) in the region of the teeth (37).

7. The displacement machine of claim 1 in which said teeth (37) of the bore are connected to the tooth gaps (38) by side surfaces, and said side surfaces are formed with said additional waves (41) which follow a helical contour of the side surfaces over at least a portion thereof.

8. The displacement machine of claim 1 in which a radial extension of said additional waves (41) in said teeth (37) of said bore is greater than a radial extension of the additional waves (41) in the tooth gaps (38) of said bore.

9. The displacement machine of claim 1 in which waves (41) in the teeth (37) of said bore are symmetrical to a crown line which follows the contour of the teeth (37) of the bore and which has a smaller radial distance from a longitudinal axis (25) of said bore.

10. The displacement machine of claim 1 in which said additional waves (41) in said bore are symmetrical to a tooth gap line which follows a helical profile of the tooth gap and which has a greater radial distance from a longitudinal axis of the bore (38).

11. The displacement machine of claim 1 in which the height of the additional waves (41) is between about 0.1 mm. and 5 mm.

12. The displacement machine of claim 1 in which the height of said additional waves (41) between 0.1 mm. and 5 mm.

13. The displacement machine of claim 1 in which the height of the additional waves (41) in the bore is of between 1% and 50% of the wall thickness of the elastic, flexible coating (32) at the corresponding position relative to a profile without waves (41).

14. The displacement machine of claim 1 in which a cross-sectional profile of the waves (41) is shaped symmetrical in the circumferential direction of the bore relative to a crown line of the teeth in said bore.

15. The displacement machine of claim 1 in which said bore is formed with a plurality of additional grooves (39) adjacent each wave (41) which similar to the additional waves (41) extend longitudinally approximately helical and whose dimensions in both the circumferential and radial directions are smaller than the dimensions of the tooth gaps (38).

16. The displacement machine of claim 15 in which said teeth (37) of the bore are connected to the tooth gaps (38) by side surfaces, and said side surfaces are formed with said additional grooves (39) which follow a helical contour of the side surfaces over at least a portion thereof.

17. The displacement machine of claim 15 in which said additional grooves (39) each is formed between two additional waves (41) of said bore such that the region between two waves (41) has a greater radial distance from an axis (25) of the bore than that of an imaginary, ideal contour line (43) of the bore without waves (41).

18. The displacement machine of claim 15 in which the depth of the additional grooves (39) in the bore is between 0.1 mm. and 5 mm.

19. The displacement machine of claim 15 in which the depth of the additional grooves (39) in the bore has a value of between 1% and 50% of the wall thickness of the elastic, flexible coating (32) at the corresponding position relative to a profile without additional waves (41).

20. A displacement machine in the form of an eccentric screw pump or motor (1) comprising a stator (3) having a tube-shaped jacket (22), said jacket (22) having a connector (26) at one end for enabling connection of the jacket (22) to another part (2, 5), said jacket having an elastic, flexible coating (32) on an inner side thereof which forms a helical bore over a region of its length, said helical bore forming an inner wall which has a cross sectional profile transverse to a longitudinal axis of the tube shaped jacket (22) defined by an edge (44) having a wave-shaped profile such that the bore defines helical teeth (37) which are separated from each other by tooth gaps (38), said teeth (37) of the bore each being formed with at least two adjacent waves (39) which generally follow the profile of the teeth (37) over a section thereof and whose dimensions in both the circumferential direction and radial direction are smaller than the dimensions of the teeth (37) and tooth gaps (38) of the bore, a rotor (4) disposed within said bore for relative rolling movement, and said rotor (4) being in the form of a spiraltoothed pinion with one or more teeth (35) and tooth gaps (36) which are disposed within the bore defined by said coating (32) such that said rotor can roll in the bore with the teeth (35) of the rotor engaging the tooth gaps (38) of the coating (32).

21. The displacement machine of claim 20 in which said teeth of said bore each formed with at least one groove (41) between two adjacent waves (39) formed in said bore.

22. The displacement machine of claim 20 in which the height of the waves (41) in the bore is of between 1% and 50% of the wall thickness of the elastic, flexible coating (32) at the corresponding position relative to a profile without waves (41).

23. The displacement machine of claim 22 in which the height of said waves (41) between 0.1 mm. and 5 mm.

24. A displacement machine in the form of an eccentric screw pump or motor (1) comprising a stator (3) having a tube-shaped jacket (22), said jacket (22) having a connector (26) at one end for enabling connection of the jacket (22) to another part (2, 5), said jacket having an elastic, flexible coating (32) on an inner side thereof which forms a helical bore over a region of its length, said helical bore forming an inner wall which has a cross sectional profile transverse to a longitudinal axis of the tube shaped jacket 22 defined by an edge (44) having a wave-shaped profile such that the bore defines helical teeth (37) which are separated from each other by tooth gaps (38), said tooth gaps (38) of the bore each being formed with at least two adjacent grooves (39) which follows the profile of the corresponding tooth gap (38) in the axial direction over a section thereof and whose dimensions both in the circumferential direction and radial direction are smaller than the dimensions of the teeth (37) and tooth gap (38) of the bore, a rotor (4) disposed within said bore for relative rolling movement, and said rotor (4) being in the form of a spiral-toothed pinion with one or more teeth (35) and tooth gaps (36) which are disposed within the bore defined by said coating (32) such that said rotor can roll in the bore with the teeth (35) of the rotor engaging the tooth gaps (38) of the coating (32).

25. The displacement machine of claim 24 in which said tooth gaps (38) are formed with at least one wave (4) between two adjacent grooves (39) of the bore.

26. The displacement machine of claim 25 in which said waves have a smaller radial dimension than said teeth of said bore.

27. The displacement machine of claim 26 in which said grooves have a smaller radial dimension than the tooth gaps of said bore.

28. A displacement machine in the form of an eccentric screw pump or motor (1) comprising a stator (3) having a tube-shaped jacket (22), said jacket (22) having a connector (26) at one end for enabling connection of the jacket (22) to another part (2, 5), said jacket having an elastic, flexible coating (32) on an inner side thereof which forms a helical bore over a region of its length, said helical bore forming an inner wall which has a cross sectional profile transverse to a longitudinal axis of the tube shaped jacket (22) defined by an edge (44) having a wave-shaped profile such that the bore defines helical teeth (37) which are separated from each other by tooth gaps (38), each said tooth (37) in said bore being formed with at least two adjacent waves (41) and one groove (39) and each tooth gap (38) of said bore being formed with at least two adjacent grooves (39) and at least one wave (41), said grooves (39) and waves (41) following the profile of the corresponding tooth (37) and tooth gap (38) over a section thereof and having dimensions both in the circumferential direction and in the radial direction which are smaller than the dimensions of the teeth (37) and tooth gaps (38) of the bore, a rotor (4) disposed within said bore for relative rolling movement, and said rotor (4) being in the form of a spiral-toothed pinion with one or more teeth (35) and tooth gaps (36) which are disposed within the bore defined by said coating (32) such that said rotor can roll in the bore with the teeth (35) of the rotor engaging the tooth gaps (38) of the coating (32).

29. The displacement machine of claim 28 in which radial dimensions of such waves and grooves are less than the radial dimensions of said teeth and tooth gaps of said bore.

30. A displacement machine in the form of an eccentric screw pump or motor comprising a stator (3) having an elastic flexible coating (32) which forms a helical bore with teeth helical (37) and tooth gaps (38), a rotor (4) disposed for rolling movement in the bore and being formed with teeth (35) and tooth gaps (36) which are engageable with the stator bore, and said bore defined by the elastic flexible coating being formed with a plurality of waves (41) and grooves (39) which, like the teeth (37) and tooth gaps (38) of the bore are helical, but which have dimensions in both the circumferential and radial directions that are smaller than the dimensions of the teeth (37) and tooth gaps (38) of the bore.

31. The displacement machine of claim 30 in which the radial dimension of said waves and grooves is less than the radial thickness of said teeth and tooth gaps of said bore.

32. The displacement machine of claim 31 in which said grooves and waves have a wall thickness of between 2 and 20% of the wall thickness of the elastic flexible coating at the corresponding position relative to a profile of the teeth and tooth gaps without said waves and grooves.

* * * * *